US008465888B2

(12) United States Patent
Tong et al.

(10) Patent No.: US 8,465,888 B2
(45) Date of Patent: Jun. 18, 2013

(54) PHOTOCONDUCTOR UNDERCOAT LAYER

(75) Inventors: Yuhua Tong, Webster, NY (US); Jin Wu, Pittsford, NY (US); Edward F. Grabowski, Webster, NY (US); Marc J. Livecchi, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 231 days.

(21) Appl. No.: 13/014,808

(22) Filed: Jan. 27, 2011

(65) Prior Publication Data

US 2012/0196216 A1 Aug. 2, 2012

(51) Int. Cl.
*G03G 5/14* (2006.01)

(52) U.S. Cl.
USPC ..... 430/58.8; 430/58.75; 430/60; 430/65

(58) Field of Classification Search
USPC ..... 430/60, 65, 58.8, 58.75
See application file for complete search history.

(56) References Cited

U.S. PATENT DOCUMENTS

| | | | | |
|---|---|---|---|---|
| 5,378,315 | A * | 1/1995 | Hendrix et al. | 134/3 |
| 7,208,545 | B1 * | 4/2007 | Brunner et al. | 524/569 |
| 7,498,109 | B2 * | 3/2009 | Wu et al. | 430/65 |
| 2008/0188601 | A1 * | 8/2008 | Grass et al. | 524/321 |

* cited by examiner

*Primary Examiner* — Christopher Rodee
(74) *Attorney, Agent, or Firm* — Hoffman Warnick LLC

(57) ABSTRACT

A photoconductor comprising a substrate, an undercoat layer, a photogenerating layer and a charge transport layer is described. The undercoat layer is disposed on the substrate and comprises a metal oxide, and a mixture of a phenolic resin and a cyclohexanecarboxylate.

19 Claims, 1 Drawing Sheet

PHOTOCONDUCTOR UNDERCOAT LAYER

BACKGROUND

1. Field of Use

This disclosure is generally directed to layered imaging members, photoreceptors, photoconductors, and the like.

2. Background

Xerographic reproduction apparatus use a photoreceptor in the form of a drum in the creation of electrostatic images upon which toner is deposited and then transferred to another drum or belt.

Reclaiming photoreceptors to lessen disposal costs and recycle materials presents a cost savings opportunity. Many jurisdictions have environmental requirements for electronic devices and these requirements force manufacturers to recycle at least 60 percent of the electronic products sold.

It is known that certain photoreceptor drums are difficult to reclaim or recycle. Reclaiming efforts require a lathing step to remove the charge transport layer, the charge generation layer and most portions of the undercoat layer before the solution stripping can begin. It would be desirable to eliminate the lathing step.

SUMMARY

Disclosed herein is a photoconductor comprising a substrate, an undercoat layer, a photogenerating layer and a charge transport layer. The undercoat layer is disposed on the substrate and comprises a metal oxide, and a mixture of a phenolic resin and a cyclohexanecarboxylate.

Disclosed herein is a photoconductive member comprised of a supporting substrate, an undercoat layer thereover comprised of a mixture of a metal oxide, a phenolic polymer and a cyclohexanecarboxylate. A photogenerating layer and a charge transport layer are disposed on the undercoat layer. In the undercoat layer, the phenolic resin is present in an amount of from about 20 weight percent to about 69 weight percent, the cyclohexanecarboxylate is present in an amount of from about 1 weight percent to about 20 weight percent, and the metal oxide is present in an amount of from about 30 weight percent to about 70 weight percent wherein the total of the components in the undercoat layer is about 100 percent.

Disclosed herein is a photoconductor comprised in sequence; a supporting substrate, a hole blocking layer thereover comprised of a mixture of a metal oxide, a phenolic formaldehyde resin, and a cyclohexanecarboxylate represented by

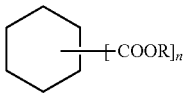

wherein R is an alkyl having from about 1 carbon atom to about 18 carbon atoms, and n is from about 1 to about 6; a photogenerating layer, and a hole transport layer; wherein the phenolic formaldehyde resin is selected from the group consisting of the reaction products of p-tert-butylphenol, cresol, and formaldehyde; 4,4'-(1-methylethylidene)bisphenol and formaldehyde; phenol, cresol, and formaldehyde; phenol, p-tert-butylphenol and formaldehyde; and mixtures thereof; the metal oxide is selected from the group consisting of titanium oxide, titanium dioxide, zinc oxide, tin oxide, aluminum oxide, silicone oxide, zirconium oxide, indium oxide, and molybdenum oxide; the photogenerating layer is comprised of a photogenerating pigment and a resin binder; and the hole transport layer is comprised of aryl amine molecules and a resin binder.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

It should be noted that some details of the figures have been simplified and are drawn to facilitate understanding of the embodiments rather than to maintain strict structural accuracy, detail, and scale.

DESCRIPTION OF THE EMBODIMENTS

In the following description, reference is made to the chemical formulas that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

Figure 1:
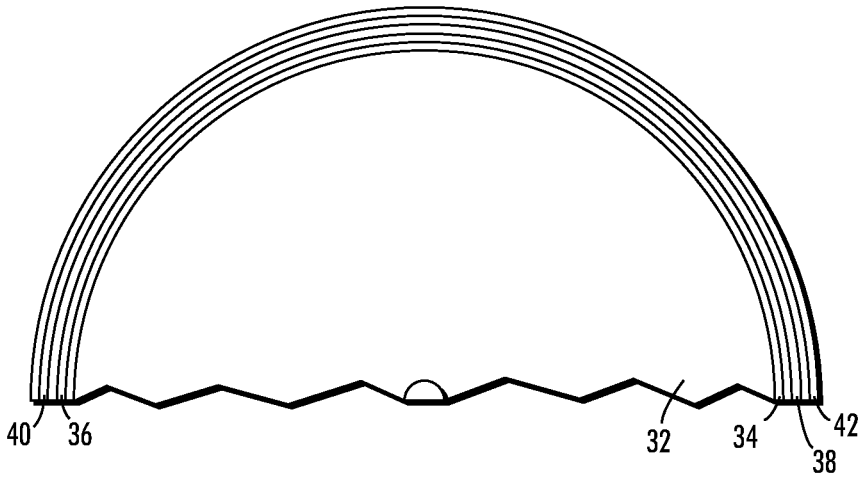
FIG. 1 is a cross-sectional view of an exemplary embodiment of a photoreceptor drum.

An exemplary embodiment of the photoconductor is shown in FIG. 1. The substrate 32 supports the other layers. An undercoat layer 34 or hole blocking layer is applied, as well as an optional adhesive layer 36. The photogenerating layer 38 is located between the optional adhesive layer 36 and the charge transport layer 40. An overcoat layer 42 is disposed upon the charge transport layer 40.

Figure 2:
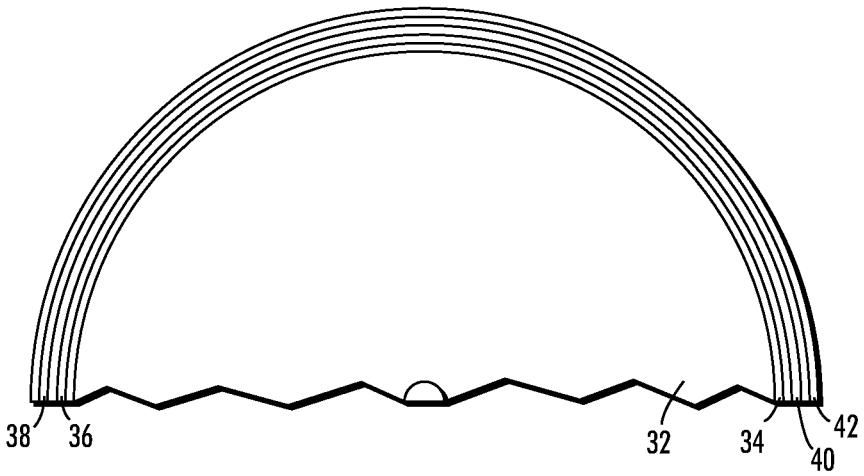
FIG. 2 is a cross-sectional view of an exemplary embodiment of a photoreceptor drum.

Another exemplary embodiment of the photoreceptor of the present disclosure is illustrated in FIG. 2. This embodiment is similar to that of FIG. 1, except locations of the photogenerating layer 38 and charge transport layer 40 are reversed. Generally, the photogenerating layer, charge transport layer, and other layers may be applied in any suitable order to produce either positive or negative charging photoreceptor drums. Although depicted as a drum in FIGS. 1 and 2, the photoconductor can be in the form of a belt or web.

Aspects of the present disclosure relate to a photoconductor comprising a substrate, and an undercoat layer thereover comprised of a metal oxide, a phenolic resin and a cyclohexanecarboxylate; a photogenerating layer; and a charge transport layer.

Aspects of the present disclosure relate to a photoconductor comprising a supporting substrate, an undercoat layer thereover comprised of a metal oxide, a phenolic resin and a cyclohexanecarboxylate; a photogenerating layer; and a charge transport layer. The phenolic resin is present in an amount of from about 20 weight percent to about 80 weight percent, the cyclohexanecarboxylate is present in an amount of from about 1 weight percent to about 30 weight percent, and the metal oxide is present in an amount of from about 20 weight percent to about 80 weight percent, and wherein the total of the components in the undercoat layer is about 100 percent.

Aspects of the present disclosure relate to a photoconductor comprised in sequence of a supporting substrate, a hole blocking layer thereover comprised of a metal oxide, a phenolic resin and a cyclohexanecarboxylate a phenolic formaldehyde resin, and a cyclohexanecarboxylate represented by

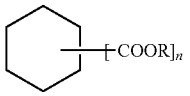

wherein R is an alkyl having from about 1 carbon atom to about 18 carbon atoms, and n is from about 1 to about 6; a photogenerating layer, and a hole transport layer; wherein the phenolic formaldehyde resin is selected from the group consisting of the reaction products of p-tert-butylphenol, cresol, and formaldehyde; 4,4'-(1-methylethylidene)bisphenol and formaldehyde; phenol, cresol and formaldehyde; phenol, p-tert-butylphenol, and formaldehyde; and mixtures thereof; the metal oxide is selected from the group consisting of titanium oxide, titanium dioxide, zinc oxide, tin oxide, aluminum oxide, silicone oxide, zirconium oxide, indium oxide, and molybdenum oxide; the photogenerating layer is comprised of a photogenerating pigment and a resin binder; and the hole transport layer is comprised of aryl amine molecules and a resin binder.

Disclosed herein is an undercoat comprising metal oxide, a phenolic resin and a cyclohexanecarboxylate used in a photoconductor. The undercoat is also referred to as a hole blocking layer. When compared with currently available undercoat layers of $TiO_2$ and phenolic resin in a photoconductor, comparable or better performance was achieved.

When a photoconductor having an undercoat of a metal oxide, a phenolic resin and a cyclohexanecarboxylate was immersed in a solution of 80% NMP, 8% citric acid and 12% water at 85° C. for 5 minutes, all the coating layers were removed without any residues left on the aluminum substrate.

Meanwhile, the adhesion of the disclosed undercoat layer to the substrate was tested using a standard protocol and the adhesion was comparable or stronger than that currently used undercoat layers.

Cyclohexanecarboxylate possesses an excellent toxicological profile and has been used in toys, food, packaging, medical devices, sports and leisure products. In addition, the disclosed cyclohexanecarboxylate possesses a high eco-efficiency since it is biodegradable and is not harmful to the environment or to human health.

Undercoat Layer Component Examples

Examples of the phenolic resin selected for the hole blocking or undercoat layer may be, for example, dicyclopentadiene type phenolic resins; phenol Novolak resins; cresol Novolak resins; phenol aralkyl resins; and mixtures thereof; polymers generated from formaldehyde, phenol, p-tert-butylphenol, and cresol, such as VARCUM™ 29159, in, for example, 50 weight percent in a 50/50 mixture of xylene/1-butanol, and 29101 (available from OxyChem Company), and DURITE™ 97 (available from Borden Chemical); polymers of formaldehyde with ammonia, cresol, and phenol, such as VARCUM™ 29112 (available from OxyChem Company); polymers of formaldehyde, and 4,4'-(1 methylethylidene)bisphenol, such as VARCUM™ 29108 and 29116 (available from OxyChem Company); polymers of formaldehyde with cresol and phenol, such as VARCUM™ 29457 (available from OxyChem Company); DURITE™ SD-423A, SD-422A (Borden Chemical); polymers of formaldehyde, phenol and p-tert-butylphenol, such as DURITE™ ESD 556C (available from Border Chemical); mixtures thereof, and a number of suitable known phenolic resins.

In embodiments, the phenolic resin or resins that may be selected for the preparation of the undercoat layer, and which resin is present in various effective amounts, such as from about 20 weight percent to about 80 weight percent, from about 30 weight percent to about 50 weight percent, and more specifically, about 38 weight percent, can be considered to be formed by the reaction condensation product of an aldehyde with a phenol source in the presence of an acidic or basic catalyst. The phenol source may be, for example, phenol; alkyl-substituted phenols, such as cresols and xylenols; halogen-substituted phenols, such as chlorophenol; polyhydric phenols, such as resorcinol or pyrocatechol; polycyclic phenols, such as naphthol and bisphenol A; aryl-substituted phenols, cyclo-alkyl-substituted phenols, aryloxy-substituted phenols, and various mixtures thereof. Examples of a number of specific phenols selected are 2,6-xylenol, o-cresol, p-cresol, 3,5-xylenol, 3,4-xylenol, 2,3,4-trimethyl phenol, 3-ethyl phenol, 3,5-diethyl phenol, p-butyl phenol, 3,5-dibutyl phenol, p-amyl phenol, p-cyclohexyl phenol, p-octyl phenol, 3,5-dicyclohexyl phenol, p-phenyl phenol, p-crotyl phenol, 3,5-dimethoxy phenol, 3,4,5-trimethoxy phenol, p-ethoxy phenol, p-butoxy phenol, 3-methyl-4-methoxy phenol, p-phenoxy phenol, multiple ring phenols, such as bisphenol A, and mixtures thereof. In embodiments, there is selected as the phenol reactant a phenol, a p-tert-butylphenol, 4,4'-(1-methylethylidene)bisphenol, and cresol.

The aldehyde reactant selected may be, for example, formaldehyde, paraformaldehyde, acetaldehyde, butyraldehyde, paraldehyde, glyoxal, furfuraldehyde, propinonaldehyde, benzaldehyde, mixtures thereof, and a number of other known aldehydes.

In embodiments, the phenolic resins selected are base-catalyzed phenolic resins that are generated with an aldehyde/phenol mole ratio of equal to or greater than one, for example, from about 1 to about 2; or from about 1.2 to about 1.8; or about 1.5, and heating at a temperature of, for example 70° C. The base catalyst selected in an amount, for example, of from about 0.1 weight percent to about 7 weight percent, from about 1 weight percent to about 5 weight percent, and about 1 weight percent for the reaction of the phenol and the aldehyde, such as an amine, is generally miscible with the phenolic resin.

Examples of cyclohexanecarboxylate can be represented by

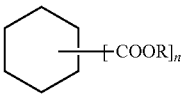

Where R is an alkyl having from about 1 carbon atom to about 18 carbon atoms, or from about 4 carbon atoms to about 16 carbon atoms, or from about 6 carbon atoms to about 12 carbon atoms, and n is from 1 to 6, or from about 1 to about 4, or n is 2. The cyclohexanecarboxylate is present in various effective amounts, such as from about 1 weight percent to about 30 weight percent, from about 2 weight percent to about 25 weight percent or from about 5 weight percent to about 20 weight percent.

A specific example is diisononyl 1,2-cyclohexanedicarboxylate (boiling point: 240-250° C.), or Hexamoll® DINCH, available from BASF. Other examples are diisononyl 1,3-cyclohexanedicarboxylate, diisononyl 1,4-cyclohexanedicarboxylate, isononyl cyclohexanecarboxylate, triisononyl 1,2,4-cyclohexanetricarboxylate, dihexyl cyclohexanedicarboxylate, hexyl cyclohexanecarboxylate, trihexyl 1,2,4-cyclohexanetricarboxylate, and the like, and mixtures thereof.

Various amounts of the phenolic resin can be selected for the undercoat layer. For example, from about 20 weight percent to about 80 weight percent, from about 30 weight percent to about 50 weight percent, and more specifically, or about 35 weight percent to about 42 weight percent of the phenolic resin can be selected, and where the total of the phenolic resin, the metal oxide, and the cyclohexanecarboxylate amounts to about 100 percent.

In embodiments, the undercoat layer metal oxide (e.g. $TiO_2$) can be either surface treated or untreated. Surface treatments include, but are not limited to, mixing the metal oxide with aluminum laurate, alumina, zirconia, silica, silane, methicone, dimethicone, sodium metaphosphate, and the like, and mixtures thereof. Examples of $TiO_2$ include MT-150W™ (surface treatment with sodium metaphosphate, available from Tayca Corporation), STR-60N™ (no surface treatment, available from Sakai Chemical Industry Co., Ltd.), FTL-100™ (no surface treatment, available from Ishihara Sangyo Laisha, Ltd.), STR-60™ (surface treatment with $Al_2O_3$, available from Sakai Chemical Industry Co., Ltd.), TTO-55N™ (no surface treatment, available from Ishihara Sangyo Laisha, Ltd.), TTO-55A™ (surface treatment with $Al_2O_3$, available from Ishihara Sangyo Laisha, Ltd.), MT-150AW™ (no surface treatment, available from Tayca Corporation), MT-150A™ (no surface treatment, available from Tayca Corporation), MT-100S™ (surface treatment with aluminum laurate and alumina, available from Tayca Corporation), MT-100HD™ (surface treatment with zirconia and alumina, available from Tayca Corporation), MT-100SA™ (surface treatment with silica and alumina, available from Tayca Corporation), and the like.

Examples of metal oxides present in suitable amounts, such as for example, from about 20 weight percent to about 80 weight percent, and more specifically, from about 30 weight percent to about 70 weight percent, or from about 40 weight percent to about 60 weight percent, are titanium oxides, and mixtures of metal oxides thereof. In embodiments, the metal oxide has a size diameter of from about 5 nanometers to about 300 nanometers, a powder resistance of from about $1\times10^3$ ohm/cm to about $6\times10^5$ ohm/cm when applied at a pressure of from about 650 kilograms/$cm^2$ to about 50 kilograms/$cm^2$, and yet more specifically, the titanium oxide possesses a primary particle size diameter of from about 10 nanometers to about 25 nanometers, and more specifically, from about 12 nanometers to about 17 nanometers, and yet more specifically, about 15 nanometers with an estimated aspect ratio of from about 4 to about 5, and is optionally surface treated with, for example, a component containing, for example, from about 1 percent by weight to about 3 percent by weight of alkali metal, such as a sodium metaphosphate, a powder resistance of from about $1\times10^4$ ohm/cm to about $6\times10^4$ ohm/cm when applied at a pressure of from about 650 kilograms/$cm^2$ to about 50 kilograms/$cm^2$; MT-150W™, and which titanium oxide is available from Tayca Corporation, and wherein the hole blocking layer is of a suitable thickness, such as a thickness of from about 0.1 micron to about 30 microns, thereby avoiding or minimizing charge leakage. Metal oxide examples in addition to titanium, such as titanium dioxide, are chromium, zinc, tin, copper, antimony, and the like, and more specifically, zinc oxide, tin oxide, aluminum oxide, silicone oxide, zirconium oxide, indium oxide, molybdenum oxide, and mixtures thereof.

The hole blocking layer can, in embodiments, be prepared by a number of known methods, the process parameters being dependent, for example, on the photoconductor member desired. The hole blocking layer can be coated as a solution or a dispersion onto the ground plane layer by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 1 minute to about 10 hours, under stationary conditions or in an air flow. The coating can be accomplished to provide a final coating thickness of from about 0.01 micron to about 30 microns, from about 0.1 micron to about 20 microns, from about 1 micron to about 15 microns, from about 4 microns to about 10 microns, from about 0.02 micron to about 0.5 micron, or from about 3 microns to about 15 microns after drying.

Photoconductor Layer Examples

The layers of the photoconductor, in addition to the undercoat layer, can be comprised of a number of known layers, such as supporting substrates, adhesive layers, photogenerating layers, charge transport layers, and protective overcoating top layers, such as the examples of these layers as illustrated in FIGS. 1 and 2.

The thickness of the photoconductive substrate layer 32 depends on many factors including economical considerations, electrical characteristics, and the like; thus, this layer may be of a substantial thickness, for example in excess of 3,100 microns, such as from about 700 microns to about 2,000 microns, from about 300 microns to about 700 microns, or of a minimum thickness of, for example, 70 microns to about 200 microns. In embodiments, the thickness of this layer is from about 75 microns to about 275 microns, or from about 95 microns to about 140 microns.

The substrate may be opaque, substantially transparent, or be of a number of other suitable known forms, and may comprise any suitable material having the required mechanical properties. Accordingly, the substrate may comprise a layer of an electrically nonconductive or conductive material such as an inorganic or an organic composition. As electrically non-conducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum this layer may be of a substantial thickness of, for example, up to many centimeters or of a minimum thickness of less than a millimeter. Similarly, a flexible belt may be of a substantial thickness of, for example, about 250 microns, or of a minimum thickness of less than about 50 microns, provided there are no adverse effects on the final electrophotographic device. In embodiments, where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, substrates 32 selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate 32 may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example, polycarbonate materials commercially available as MAKROLON®.

The photogenerating layer 38 in embodiments is comprised of, for example, a number of known photogenerating pigments including, for example, Type V hydroxygallium phthalocyanine, Type IV or V titanyl phthalocyanine or chlorogallium phthalocyanine, and a resin binder like poly(vinyl chloride-co-vinyl acetate) copolymer, such as VMCH (available from Dow Chemical), or polycarbonate. Generally, the photogenerating layer 38 can contain known photogenerating pigments, such as metal phthalocyanines, metal free phthalocyanines, alkylhydroxygallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer 40, or alternatively no resin binder need be present. Generally, the thickness of the photogenerating layer 38 depends on a number of factors, including the thicknesses of the other layers, and the amount of photogenerating material contained in the photogenerating layer 38. Accordingly, this layer can be of a thickness of, for example, from about 0.05 micron to about 10 microns, and more specifically, from about 0.25 micron to about 2 microns when, for example, the photogenerating compositions are present in an amount of from about 30 percent by volume to about 75 percent by volume. The maximum thickness of this layer, in embodiments, is dependent upon factors, such as photosensitivity, electrical properties, and mechanical considerations. The photogenerating layer 38 binder resin is present in various suitable amounts of, for example, from about 1 weight percent to about 50 weight percent, and more specifically, from about 1 weight percent to about 10 weight percent, and which resin may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Generally, however, from about 5 percent by volume to about 90 percent by volume of the photogenerating pigment is dispersed in about 10 percent by volume to about 95 percent by volume of the resinous binder, or from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition. Examples of coating solvents for the photogenerating layer 38 are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer 38 may comprise amorphous films of selenium and alloys of selenium and arsenic, tellurium, germanium, and the like, hydrogenated amorphous silicone and compounds of silicone and germanium, carbon, oxygen, nitrogen, and the like fabricated by vacuum evaporation or deposition. The photogenerating layer 38 may also comprise inorganic pigments of crystalline selenium and its alloys; Groups II to VI compounds; and organic pigments such as quinacridones; polycyclic pigments such as dibromo anthanthrone pigments, perylene and perinone diamines; polynuclear aromatic quinones, azo pigments including bis-, tris- and tetrakis-azos, and the like dispersed in a film forming polymeric binder and fabricated by solvent coating techniques.

Examples of polymeric binder materials that can be selected as the matrix for the photogenerating layer 38 components are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene-butadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

Various suitable and conventional known processes may be selected to mix, and thereafter apply the photogenerating layer coating mixture to the substrate 32, and more specifically, to the undercoat layer 34 or other layers like spraying, dip coating, roll coating, wire wound rod coating, vacuum sublimation, and the like. For some applications, the photogenerating layer 38 may be fabricated in a dot or line pattern. Removal of the solvent of a solvent-coated layer may be effected by any known conventional techniques such as oven drying, infrared radiation drying, air drying, and the like. The coating of the photogenerating layer 38 on the undercoat layer 34 in embodiments of the present disclosure can be accomplished such that the final dry thickness of the photogenerating layer 38 is as illustrated herein, and can be, for example, from about 0.01 micron to about 30 microns after being dried at, for example, about 40° C. to about 150° C. for about 1 minute to about 90 minutes. More specifically, a photogenerating layer 38 of a thickness, for example, of from about 0.1 micron to about 30 microns, or from about 0.5 micron to about 2 microns can be applied to or deposited on the substrate, on other surfaces in between the substrate and the charge transport layer, and the like. The undercoat layer 34 may be applied to the ground plane layer prior to the application of a photogenerating layer 38.

A suitable known adhesive layer 36 can be included in the photoconductor. Typical adhesive layer materials include, for example, polyesters, polyurethanes, and the like. The adhesive layer thickness can vary, and in embodiments is, for example, from about 0.05 micron to about 0.3 micron. The adhesive layer 36 can be deposited on the undercoat layer 34 by spraying, dip coating, roll coating, wire wound rod coating, gravure coating, Bird applicator coating, and the like. Drying of the deposited coating may be effected by, for example, oven drying, infrared radiation drying, air drying, and the like. As optional adhesive layer 36 usually in contact with or situated between the undercoat layer 34 and the photogenerating layer 38, there can be selected various known substances inclusive of copolyesters, polyamides, poly(vinyl butyral), poly(vinyl alcohol), polyurethane, and polyacrylonitrile. The adhesive layer 36 is, for example, of a thickness of from about 0.001 micron to about 1 micron, or from about 0.1 micron to about 0.5 micron. Optionally, the adhesive layer 36 may contain effective suitable amounts, for example from about 1 weight percent to about 10 weight percent, of conductive and nonconductive particles, such as zinc oxide, titanium dioxide, silicone nitride, carbon black, and the like, to provide, for example, in embodiments of the present disclosure, further desirable electrical and optical properties.

A number of charge transport materials, especially known hole transport molecules, and polymers may be selected for the charge transport layer 40, examples of which are aryl amines of the following formulas/structures, and which layer is generally of a thickness of from about 5 microns to about 90 microns, and more specifically, of a thickness of from about 10 microns to about 40 microns

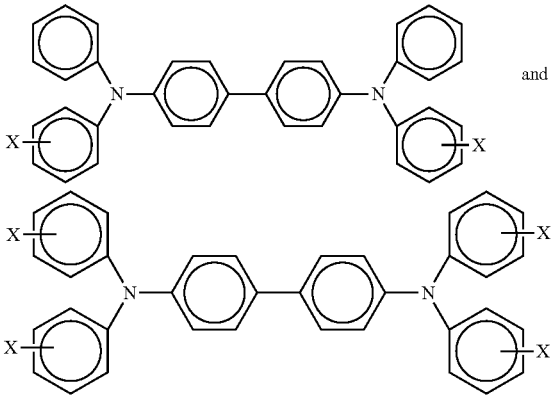

and wherein X is a suitable hydrocarbon like alkyl, alkoxy, and aryl, a halogen, or mixtures thereof, and especially those substituents selected from the group consisting of Cl and $CH_3$; and molecules of the following formulas

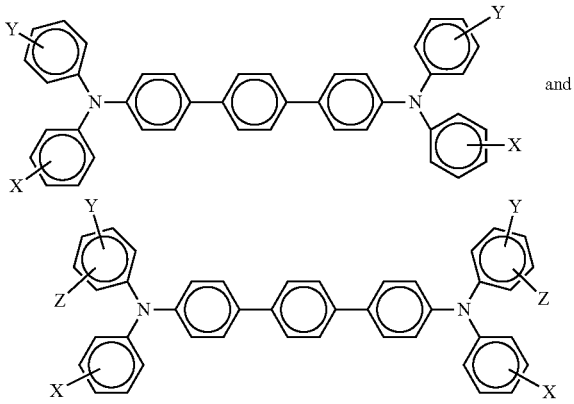

and wherein X, Y and Z are a suitable substituent like a hydrocarbon, such as independently alkyl, alkoxy, or aryl, a halogen, or mixtures thereof. Alkyl and alkoxy contain, for example, from 1 carbon atom to about 25 carbon atoms, from 1 carbon atom to about 18 carbon atoms, from 1 carbon atom to about 12 carbon atoms, and more specifically, from 1 carbon atom to about 6 carbon atoms and from 1 carbon atom to about 4 carbon atoms, such as methyl, ethyl, propyl, butyl, pentyl, and the corresponding alkoxides. Aryl can contain from 6 carbon atoms to about 42 carbon atoms, from 6 carbon atoms to about 36 carbon atoms, from 6 carbon atoms to about 24 carbon atoms, from 6 carbon atoms to about 18 carbon atoms, such as phenyl, and the like. Halogen includes chloride, bromide, iodide, and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layer 40 or layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidine diphenylene)carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, electrically inactive binders can be comprised of polycarbonate resins with a molecular weight ($M_w$) of from about 20,000 to about 100,000, or with a molecular weight $M_w$ of from about 50,000 to about 100,000 preferred. Generally, the transport layer contains from about 10 percent by weight to about 75 percent by weight of the charge transport material, and more specifically, from about 35 percent by weight to about 50 percent of this material.

The charge transport layer 40 or layers, and more specifically, a first charge transport layer in contact with the photogenerating layer 38, and thereover a top or second charge transport overcoating layer 42 may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer 40 or layers. In embodiments, charge transport refers, for example, to charge transporting molecules as a monomer that allows the free charge generated in the photogenerating layer 38 to be transported across the charge transport layer 40.

Examples of transporting components and molecules selected for the charge transport layer or layers, and present in various effective amounts include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine; hydrazones such as N-phenyl-N-methyl-3-(9-ethyl) carbazyl hydrazone, and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. A small molecule charge transporting compound that permits injection of holes into the photogenerating layer with high efficiency, and transports them across the charge transport layer with short transit times includes N,N'-diphenyl-N,N'-bis(3-methylphenyl)-(1,1'-biphenyl)-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material, or a combination of a small molecule charge transport material and a polymeric charge transport material.

In embodiments, the charge transport component can be represented by the following formulas/structures

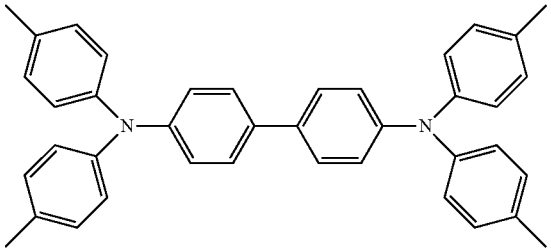

,

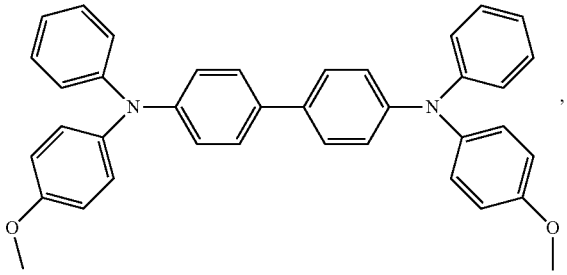

,

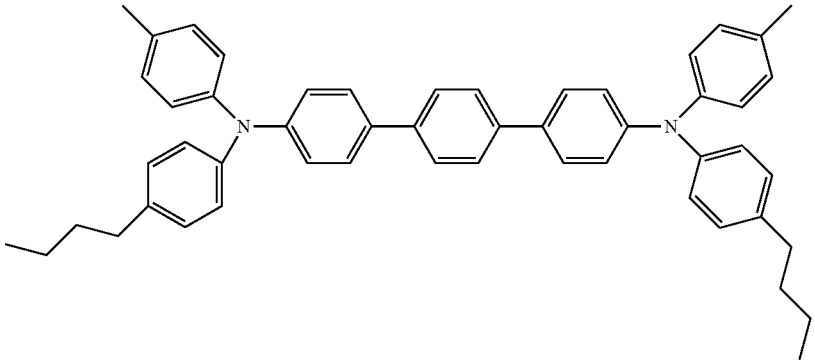

,

-continued

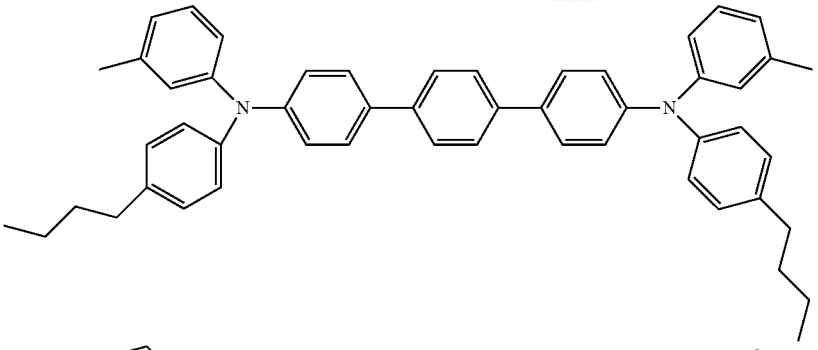

, and

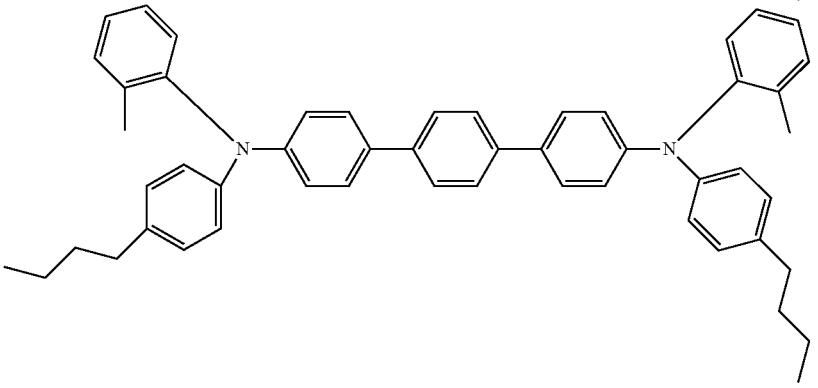

.

Examples of components or materials optionally incorporated into the charge transport layers, or at least one charge transport layer to, for example, assist in lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NR, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 weight percent to about 20 weight percent, from about 1 weight percent to about 10 weight percent, or from about 3 weight percent to about 8 weight percent.

A number of processes may be used to mix, and thereafter apply the charge transport layer or layers coating mixture to the photogenerating layer. Typical application techniques include spraying, dip coating, and roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is, for example, from about 10 microns to about 75 microns, from about 15 microns to about 50 microns, but thicknesses outside these ranges may, in embodiments, also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to about 200:1, and in some instances 400:1. The charge transport layer is substantially nonabsorbing to visible light or radiation in the region of intended use, but is electrically "active" in that it allows the injection of photogenerated holes from the photoconductive layer or photogenerating layer, and allows these holes to be transported through itself to selectively discharge a surface charge on the surface of the active layer.

The thickness of the continuous charge transport layer selected depends upon the abrasiveness of the charging (bias charging roll), cleaning (blade or web), development (brush), transfer (bias transfer roll), and the like in the system employed, and can be up to about 10 microns. In embodiments, the thickness for each charge transport layer can be, for example, from about 1 micron to about 5 microns. Various suitable and conventional methods may be used to mix, and thereafter apply an overcoat top charge transport layer coating mixture to the photoconductor. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoat layer of this disclosure should transport holes during imaging, and should not have too high a free carrier concentration. Free carrier concentration in the overcoat increases the dark decay. $M_w$, weight average molecular weight, and $M_n$, number average molecular weight were determined by Gel Permeation Chromatography (GPC).

Disclosed herein is an undercoat comprising metal oxide, a phenolic resin and a cyclohexanecarboxylate used in a photoconductor. The undercoat is also referred to as a hole blocking layer. The undercoat layer disclosed is removed by immersing the photoconductor in a solution of NMP/citric acid/water. The solution is heated to a temperature of from about 50° C. to about 100° C., or from about 55° C. to about 95° C., or from about 60° C. to about 90° C., for a time of from about 1 minute to 60 minutes, or from about 5 minute to 45 minutes, or from about 10 minute to 30 minutes, to completely remove the undercoat layer. Once the undercoat layer is removed recycling of the substrate material can be accomplished.

An undercoat of interest is one which is removed from a substrate using normal solvents and buffers, for example, a buffer containing an aprotic polar material and/or a weak acid, and under unremarkable treatment conditions, such as, at atmospheric pressure, that is, a vacuum is not needed and/or temperatures less than about 100° C., less than about 95° C., less than about 90° C., less than about 85° C., less than about 80° C., less than about 75° C. and so on.

While embodiments have been illustrated with respect to one or more implementations, alterations and/or modifications can be made to the illustrated examples without departing from the spirit and scope of the appended claims. In addition, while a particular feature herein may have been disclosed with respect to only one of several implementations, such feature may be combined with one or more other features of the other implementations as may be desired and advantageous for any given or particular function.

COMPARATIVE EXAMPLE 1

A hole blocking layer or undercoat layer dispersion was prepared by milling 18 grams or 60 wt % of $TiO_2$ (MT-150W, manufactured by Tayca Co., Japan), and 24 grams or 40 wt % of the phenolic resin, VARCUM™ 29159, (OxyChem Co., a formaldehyde, phenol, p-tert-butylphenol, cresol polymer in a solvent mixture of xylene/1-butanol, 50/50, weight average molecular weight, $M_w$, of 2,000) with a total solid content of about 48 wt % in an attritor mill with about 0.4 millimeter to about 0.6 millimeter diameter $ZrO_2$ beads for 6.5 hours. The dispersion was filtered though a 20 micron Nylon filter. A 30 millimeter aluminum drum substrate then was coated with the aforementioned filtered dispersion by dip coating. After drying at 160° C. for 20 minutes, a hole blocking layer of $TiO_2$ and the phenolic resin ($TiO_2$/phenolic resin ratio of 60/40) about 8 microns in thickness was obtained.

A photogenerating layer comprising chlorogallium phthalocyanine was deposited on the above hole blocking layer or undercoat layer at a thickness of about 0.2 micron. The photogenerating layer coating dispersion was prepared by mixing 2.7 grams or 5.4 wt % of chlorogallium phthalocyanine (ClGaPc) Type C pigment, 2.3 grams or 4.6 wt % of the polymeric binder, VMCH (carboxyl modified vinyl copolymer, Dow Chemical Company), 15 grams or 30 wt % of n-butyl acetate and 30 grams or 60 wt % of xylene. The resulting mixture was milled in an attritor mill with about 200 grams of 1 millimeter Hi-Bea borosilicate glass beads for about 3 hours. The dispersion mixture obtained then was filtered through a 20 micron Nylon cloth filter resulting in a solids content of the dispersion after dilution of about 6 wt %.

Subsequently, using known dip coating process, a 30 micron thick CTL was coated on top of the photogenerating layer using a dispersion prepared from N,N'-diphenyl-N,N-bis(3-methylphenyl)-1,1'-biphenyl-4,4'-diamine (5.38 grams or 13.4 wt %), a film-forming polymer binder, PCZ-400 ([poly(4,4'-dihydroxy-diphenyl-1-1-cyclohexane, $M_w$=40,000)] available from Mitsubishi Gas Chemical Company, Ltd.) (7.13 grams or 17.7 wt %) and PTFE POLYFLON™ L-2 microparticles (1 gram or 2.5 wt %) available from Daikin Industries in a solvent mixture of 20 grams or 49.7 wt % of tetrahydrofuran (THF), and 6.7 grams or 16.7 wt % of toluene processed through a CAVIPRO™ 300 nanomizer (Five Star Technology, Cleveland, Ohio). The CTL was dried at about 120° C. for about 40 minutes.

EXAMPLE 1

A photoconductor was prepared by repeating the above process of Comparative Example 1, except that 1.5 grams or 4.8 wt % of the cyclohexanecarboxylate, diisononyl 1,2-cyclohexanedicarboxylate, or Hexamoll® DINCH, available from BASF, was added into the hole blocking layer dispersion of Comparative Example 1, with the amounts of the remaining ingredients reduced accordingly.

A 30 millimeter aluminum drum substrate then was coated with the aforementioned generated dispersion. More specifically, after drying at 160° C. for 20 minutes, a hole blocking layer of $TiO_2$ in a mixture of phenolic resin and the above cyclohexanecarboxylate ($TiO_2$/phenolic resin/cyclohexanecarboxylate ratio of 57.1/38.1/4.8) was coated on the 30 millimeter aluminum drum in accordance with the process of Comparative Example 1 resulting in an about 8 micron thick hole blocking layer.

Electrical Property Testing

The above prepared photoconductors of Comparative Example 1 and of Example 1 were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves (PIDC) from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The photoconductors were tested at surface potentials of 700 volts with the exposure light intensity incrementally increased by regulating a series of neutral density filters. The exposure light source was a 780 nanometer light emitting diode. The xerographic simulation was conducted in an environmentally controlled, light tight chamber at dry conditions (10% relative humidity and 22° C.).

The above prepared photoconductors exhibited substantially similar PIDCs. Thus, incorporation of the cyclohexanecarboxylate of Example 1 into the hole blocking or undercoat layer did not adversely impact the electrical properties of the photoconductor.

Ghosting Measurement

The Comparative Example 1 and the Example 1 photoconductors were acclimated at room temperature for 24 hours before testing in a closed container chamber (85° F. and 80% humidity) for A ghosting. Print testing was accomplished in the Xerox Corp. WorkCentre™ Pro C3545 using the K (black toner) station at t of 500 print counts (t=500 is the 500$^{th}$ print) and in the CMY station of the color WorkCentre™ Pro C3545 which operated from t of 0 to t of 500 print counts. The prints for determining ghosting characteristics include placing an X symbol or letter on a half tone image. When X is invisible, the ghost level is assigned Grade 0; when X is barely visible, the ghost level is assigned Grade 1; and Grade 2 to Grade 5 refer to the level of visibility of X with Grade 5 being a dark and visible X. Ghosting levels were visually measured against an empirical scale, the lower the ghosting grade (absolute value), the better the print quality. The ghosting results are summarized in Table 1.

The Comparative Example 1 and Example 1 photoconductors were also acclimated in J zone conditions (75° F. and 10% humidity) in a closed container chamber for 24 hours before print tested, as above, to assess J zone ghosting. The ghosting results also are summarized in Table 1.

TABLE 1

| UCL Composition | A Zone Ghosting T = 500 prints | J Zone Ghosting T = 500 prints |
|---|---|---|
| Comparative Example 1 (No cyclohexanecarboxylate) | Grade −5 | Grade −6 |
| Example 1 (4.8 wt % of the cyclohexanecarboxylate) | Grade −3 | Grade −4 |

Incorporation of the cyclohexanecarboxylate into the undercoat layer (UCL) reduced ghosting by about 2 grades in both A zone and J zone, which reduction results in superior xerographic print quality, as determined by visual observation.

Adhesion Test

The adhesion characteristics of the Comparative Example 1 and the Example 1 photoconductors, between the hole blocking or undercoat layer and the aluminum drum substrate thereof, was tested using the following process.

The photoconductor drums were scored with a razor in a crosshatch pattern at about 4 millimeter to about 6 millimeter spacing. A 1 inch piece of commercially available scotch tape (3M) then was affixed to the scored site of each photoconductor, and then removed to determine the amount of delamination of the layered material onto the adhesive tape. The results are summarized in Table 2. The scale ranges from Grade 1 to Grade 5 where Grade 1 is almost no delamination and Grade 5 is almost complete delamination.

TABLE 2

| UCL Composition | Adhesion Grade |
|---|---|
| Comparative Example 1 (No cyclohexanecarboxylate) | 1.5 |
| Example 1 (4.8 wt % of the cyclohexanecarboxylate) | 1.5 |

Incorporation of the cyclohexanecarboxylate into the undercoat or hole blocking layer had substantially no impact on the adhesion characteristics between the hole blocking or undercoat layer and the substrate.

Coating Layers Removal

The photoconductors of Comparative Example 1 and of Example 1 separately were immersed in a solution of 80 wt % of N-methyl-2-pyrrolidone (NMP), 8 wt % of citric acid and 12 wt % of water at 85° C. The hole blocking coating layer removal of the experimental photoreceptor was compared with the immersion time and the percent of the hole blocking layer removal of the control by visual observation, resulting in the data summarized in Table 3. The aluminum substrate is a shiny silver color while the coating layer is green.

It was determined by visual observation by the absence of the green color that by adding the cyclohexanecarboxylate to the hole blocking or undercoat layer, the coating layers of the experimental photoreceptor were removed completely in the stripping protocol.

TABLE 3

| UCL Composition | Incubation Time of Coating Layer Reaction |
|---|---|
| Comparative Example 1 (No cyclohexanecarboxylate) | At 10 Min., ~90% of Coating Layers Remain |
| Example 1 (4.8 wt % of the cyclohexanecarboxylate) | 5 Min. for Complete Removal (100%) of All Coating Layers |

Incorporation of the cyclohexanecarboxylate in the hole blocking layer facilitated layer removal, only a 5-minute incubation was needed to completely remove the coating layers from the substrate for the Example 1 photoconductor. In contrast, after 10 minutes, 90% of the coating layers (including CTL, CGL and UCL) remained on the substrate of the Comparative Example 1 photoconductor (no cyclohexanecarboxylate in the undercoat layer).

It will be appreciated that variants of the above-disclosed and other features and functions or alternatives thereof, may be combined into other different systems or applications. Various presently unforeseen or unanticipated alternatives, modifications, variations, or improvements therein may be subsequently made by those skilled in the art which are also encompassed by the following claims.

What is claimed is:

1. A photoconductor comprising:

a substrate an undercoat layer comprising a metal oxide, and a mixture of a phenolic resin and a cycloheaxanecarboxylate disposed on the substrate;

a photogenerating layer; and a charge transport layer.

2. The photoconductor in accordance with claim 1 wherein the cyclohexanecarboxylate is represented by

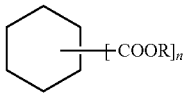

wherein R is an alkyl having from about 1 carbon atom to about 18 carbon atoms, and n is from about 1 to about 6.

3. A photoconductor in accordance with claim 1 wherein said phenolic resin is generated from a condensation product of a phenol and an aldehyde, and wherein said phenol is one of phenol, alkyl-substituted phenols, halogen-substituted phenols, polyhydric phenols, polycyclic phenols, aryl-substituted phenols, cyclo-alkyl-substituted phenols, aryloxy-substituted phenols, and mixtures thereof, and said aldehyde is one of formaldehyde, paraformaldehyde, acetaldehyde, butyraldehyde, paraldehyde, glyoxal, furfuraldehyde, propinonaldehyde, benzaldehyde, and mixtures thereof.

4. A photoconductor in accordance with claim 1 wherein said phenolic resin is present in said undercoat layer in an amount of from about 20 weight percent to about 80 weight percent, and said cyclohexanecarboxylate is present in said undercoat layer in an amount of from about 30 weight percent to about 1 weight percent, and the metal oxide is present is said undercoat layer in an amount of from about 20 weight percent to about 80 weight percent wherein the total of said phenolic resin, said metal oxide and said cycloheanecarboxylate is about 100 percent.

5. A photoconductor in accordance with claim 1 wherein said cyclohexanecarboxylate is present in an amount of from about 1 weight percent to about 30 weight percent based on the components present in said undercoat layer.

6. A photoconductor in accordance with claim 1 wherein said metal oxide is selected from the group consisting of titanium oxide, zinc oxide, tin oxide, aluminum oxide, silicon oxide, zirconium oxide, indium oxide, or molybdenum oxide.

7. A photoconductor in accordance with claim 1 wherein said metal oxide comprises a titanium dioxide present in an amount of from about 20 weight percent to about 80 weight percent based on the weight percent of said undercoat layer components.

8. A photoconductor in accordance with claim 1 wherein said metal oxide comprises a sodium metaphosphate treated titanium dioxide present in an amount of from about 30 weight percent to about 70 weight percent based on the weight percent of said undercoat layer components.

9. A photoconductor in accordance with claim 1 wherein said metal oxide is surface treated with aluminum lamurate, alumina, zirconia, silica, silane, methicone, dimethicone, sodium metaphosphate, or mixtures thereof.

10. A photoconductor in accordance with claim 1 wherein the thickness of the undercoat layer is from about 0.01 micron to about 30 microns.

11. A photoconductor in accordance with claim 1 wherein said charge transport layer is comprised of at least one of

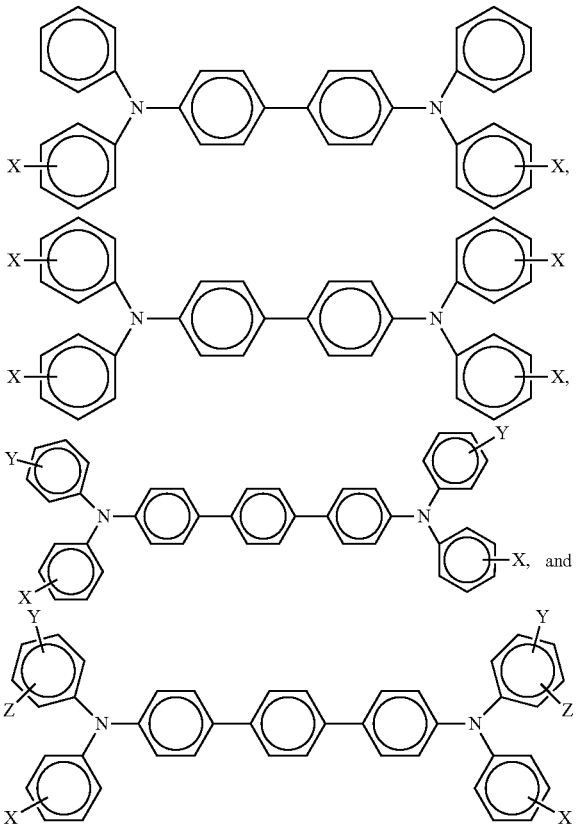

wherein X, Y, and Z are independently selected from the group consisting of alkyl, alkoxy, aryl and halogen.

12. A photoconductor in accordance with claim 1 wherein said charge transport layer is comprised of a component selected from the group consisting of N,N'-bis(methylphenyl)-1,1-biphenyl-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine.

13. A photoconductor in accordance with claim 1 wherein said photogenerating layer is comprised of at least one photogenerating pigment.

14. A photoconductor in accordance with claim 1 wherein said charge transport layer is comprised of a charge transport component and a resin binder, and wherein said photogenerating layer is comprised of at least one photogenerating pigment and a resin binder; and wherein said photogenerating layer is situated between said substrate and said charge transport layer.

15. A photoconductor comprising a supporting substrate, an undercoat layer thereover comprised of a mixture of a metal oxide, a phenolic polymer and a cyclohexanecarboxylate; a photogenerating layer, and a charge transport layer, and wherein said phenolic resin is present in an amount of from about 20 weight percent to about 80 weight percent, said cyclohexancarboxylate is present in an amount of from about 1 weight percent to about 30 weight percent, and wherein said metal oxide is present in an amount of from about 20 weight percent to about 80 weight percent, and wherein the total of said components in said undercoat layer is about 100 percent.

16. A photoconductor comprised in sequence of a supporting substrate, a hole blocking layer thereover comprised of a mixture of a metal oxide, a phenolic formaldehyde resin, and a cyclohexanecarboxylate represented by

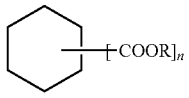

wherein R is an alkyl having from about 1 carbon atom to about 18 carbon atoms, and n is from about 1 to about 6; a photogenerating layer, and a hole transport layer; wherein the phenolic formaldehyde resin is selected from the group consisting of the reaction products of p-tert-butylphenol, cresol, and formaldehyde; 4,4'-(1-methylethylidene)bisphenol and formaldehyde; phenol, cresol, and formaldehyde; phenol, p-tert-butylphenol and formaldehyde; and mixtures thereof; the metal oxide is selected from the group consisting of titanium oxide, titanium dioxide, zinc oxide, tin oxide, aluminum oxide, silicone oxide, zirconium oxide, indium oxide, and molybdenum oxide; the photogenerating layer is comprised of a photogenerating pigment and a resin binder; and the hole transport layer is comprised of aryl amine molecules and a resin binder.

17. A photoconductor in accordance with claim 16 wherein the thickness of the hole blocking layer is from about 0.01 micron to about 30 microns.

18. A photoconductor in accordance with claim 16 wherein the cyclohexanecarboxylate is selected from the group consisting of diisononyl 1,2-cyclohexanedicarboxylate, diisononyl 1,3-cyclohexanedicarboxylate, diisononyl 1,4-cyclohexanedicarboxylate, isononyl cyclohexanecarboxylate, triisononyl 1,2,4-cyclohexanetricarboxylate, dihexyl cyclohexanedicarboxylate, hexyl cyclohexanecarboxylate and trihexyl 1,2,4-cyclohexanetricarboxylate.

19. The photoconductor in accordance with claim 16 wherein said metal oxide is selected from the group consisting of titanium oxide, zinc oxide, tin oxide, aluminum oxide, silicone oxide, zirconium oxide, indium oxide, or molybdenum oxide.

* * * * *